US007669481B2

(12) United States Patent
Lopreiato

(10) Patent No.: US 7,669,481 B2
(45) Date of Patent: Mar. 2, 2010

(54) SYSTEM FOR MONITORING LEVEL VARIATIONS IN A SOIL SUBJECTED TO EROSIVE AND SEDIMENTARY AGENTS, AND MONITORING METHOD AND ELEMENT

(75) Inventor: Domenico Lopreiato, Turin (IT)

(73) Assignee: Lachesi Srl, Turin (IT)

( * ) Notice: Subject to any disclaimer, the term of this patent is extended or adjusted under 35 U.S.C. 154(b) by 132 days.

(21) Appl. No.: 11/795,956

(22) PCT Filed: Jan. 27, 2005

(86) PCT No.: PCT/IT2005/000040

§ 371 (c)(1),
(2), (4) Date: Jul. 25, 2007

(87) PCT Pub. No.: WO2006/080037

PCT Pub. Date: Aug. 3, 2006

(65) Prior Publication Data

US 2008/0092656 A1 Apr. 24, 2008

(51) Int. Cl.
*G01L 1/00* (2006.01)

(52) U.S. Cl. ..... 73/778

(58) Field of Classification Search ..... 73/778
See application file for complete search history.

(56) References Cited

U.S. PATENT DOCUMENTS 3,946,598 A * 3/1976 Towne et al. ..... 73/594
4,250,974 A * 2/1981 Heilhecker et al. ..... 175/48
4,483,197 A * 11/1984 Kellner ..... 73/784
4,554,819 A * 11/1985 Ali ..... 73/9
4,715,022 A * 12/1987 Yeo ..... 367/83
5,022,262 A * 6/1991 Hulsbergen et al. ..... 73/170.32
5,753,818 A * 5/1998 Mercado ..... 73/594
6,679,105 B1 * 1/2004 Jepsen et al. ..... 73/86
6,899,178 B2 * 5/2005 Tubel ..... 166/313
2003/0213299 A1 11/2003 Arndt

FOREIGN PATENT DOCUMENTS

JP 11125524 5/1999
JP 2001108491 4/2001

OTHER PUBLICATIONS

International Search Report mailed May 26, 2006 in PCT/IB2006/050310.

* cited by examiner

*Primary Examiner*—Lisa M Caputo
*Assistant Examiner*—Octavia Davis
(74) *Attorney, Agent, or Firm*—Nixon & Vanderhye P.C.

(57) ABSTRACT

A system for monitoring level variations of at least one bottom region (20) of a soil subjected to erosive and sedimentary agents, which comprises at least one monitoring element (15) fastened to the bottom, the at least one monitoring element (15) comprises a sensor apparatus (120) for detecting a response ($|u_x|$) of the at least one monitoring element (15) with respect to a stress ($f_s$). The stress ($f_s$) is a stress able to determine vibrations originating displacements ($|u_x|$) of at least part of the at least one monitoring element, the response is a function of the displacements ($|u_x|$) of at least part of the at least one monitoring element (15) and apparatus (150) are provided for analyzing the response with respect to a stress ($f_s$), identifying characteristic frequencies ($\lambda_i$*) and correlate the characteristic frequencies ($\lambda_i$*) with a lowering ($\Delta l_p$) of the bottom region (20).

24 Claims, 8 Drawing Sheets

SYSTEM FOR MONITORING LEVEL VARIATIONS IN A SOIL SUBJECTED TO EROSIVE AND SEDIMENTARY AGENTS, AND MONITORING METHOD AND ELEMENT

This application is the U.S. national phase of international application PCT/IT2005/000040 filed 27 Jan. 2005 which designated the U.S., the entire content of which is hereby incorporated by reference.

The present invention relates to a system for monitoring level variations of at least one bottom region of a soil subjected to erosive and sedimentary agents, which comprises a monitoring element fastened to said bottom, said monitoring element comprising sensor means for detecting a response of said monitoring element to a stress.

The invention is particularly aimed at monitoring the stability of support elements, particularly vertical support elements, e.g. piers, posts or pillars of hydraulic structures such as bridges, which are subjected to erosive and sedimentary agents, such as the flow of water of a river. Although the present invention was developed with reference to piers supporting bridges, the invention is applicable to any field in which there is a support element, in particular vertical, which operates in similar conditions to those in which the aforesaid piers of bridges operate, e.g. elements which operate in soils that are prone to collapses, or the monitoring of the stability of trellises subjected to the action of the winds. The system and the related monitoring method and element and according to the invention are applicable also to monitoring operations on the level of the soil, be it a bottom of rivers or soils exposed to the air, not connected to a particular support element standing on said soil.

A vertical support element can be schematically represented in FIG. 1, in which the reference number 10 designates a vertical support element driven into the soil, e.g. the bed of a river, a bottom whereof is designated by the reference number 20. With reference to FIG. 1, an underground length of the pier 10 in the bottom 20 is designated by the reference L', whilst a free length of the pier 10 over the bottom 20 is designated by the reference 1'. As a result of a flood, the bottom 20 wherefrom emerges the pier 10, which can be, for example, a pillar supporting a bridge, can be eroded by effect of the turbulence and of the distortion in the stream, induced by the pier itself, which occurs in its proximity, thereby causing the "undermining" of the foundations. There is a consequent loss of stability of the support pillar, which implies a loss of stability of the bridge itself. The effect of this undermining phenomenon can be represented with the reduction in the underground length L', corresponding to a lowering $\Delta l_p$ of the bottom 290 with the consequent increase in the free length l'.

Prior art systems for monitoring the stability of vertical support elements are known which use sensor elements external to the monitored elements, positioned in similar conditions with respect to the lowering of the bottom whereon the support element stands.

Document EP0459749-B1 describes a monitoring system which comprises an oscillating arm sensor with positioned on a pillar of a mole. This monitoring system, used in particular to monitor riverbeds, provides for the presence of a sensor which relates the alarm signal with the state of the monitored riverbed. This sensor, is composed of an oscillating arm which comprises an end part that contains an omnidirectional mercury switch. This sensor is embedded in the river and dimensioned in such a way that, when it is uncovered by erosion, a sufficient flow of water enables the sensor to supply an alarm signal in response to the corresponding erosion of the riverbed.

Therefore, known prior art monitoring elements, such as the previous one, allow to monitor hydraulic structures, but the measurements obtained from these monitoring elements are of the on/off type; this depends on the fact that the sensors used operate in a mode that depends on flow variations. The sensors described in the document EP0459749-B1 are activated by an anomalous flow and provide discrete measurements, limited to the periods in which the anomalous flow condition occurs.

The systems that employ sensors of this kind therefore do not allow to obtain measurements with continuity and do not allow the "on command" analysis of the situation of the monitored hydraulic structures.

The object of the present invention is to solve the problem specified above in simple and effective manner, providing a monitoring system that is able to operate on command and with continuity.

In view of the achievement of said object, the invention relates to a system for monitoring level variations of a soil subjected to erosive and sedimentary agents having the characteristics indicated in the following embodiment:

A system for monitoring level variations of at least one bottom region (20) of a soil subjected to erosive and sedimentary agents, which comprises at least one monitoring element (15) secured to said bottom region (20), said at least one monitoring element (15) comprising sensor means (120) to detect a response ($|u_x|$) of said at least one monitoring element (15) with respect to a stress ($f_s$), wherein said stress ($f_s$) is a stress able to determine vibrations originating displacements ($|u_x|$) of at least part of said at least one monitoring element, said response is a function of said displacements ($|u_x|$) of at least part of said at least one monitoring element (15) and that means (150) are provided for analysing said response with respect to a stress ($f_s$), identifying characteristic frequencies ($\lambda^*_i$) and correlating said characteristic frequencies ($\lambda^*_i$) with a lowering ($\Delta l_p$) of said bottom region (20).

Other embodiments of the system are described in the subsequent disclosure. The invention further relates to a monitoring method and a monitoring element which exploit the characteristics of the described monitoring system.

The invention will be now described with reference to the accompanying drawings, provided purely by way of non limiting example, in which:

FIG. 1 has already been described above;

FIG. 2 shows a schematic representation of a monitoring element according to the invention in working position;

FIGS. 3*a* and 3*b* schematically show constructive details of the monitoring element of FIG. 2;

Figure 2:
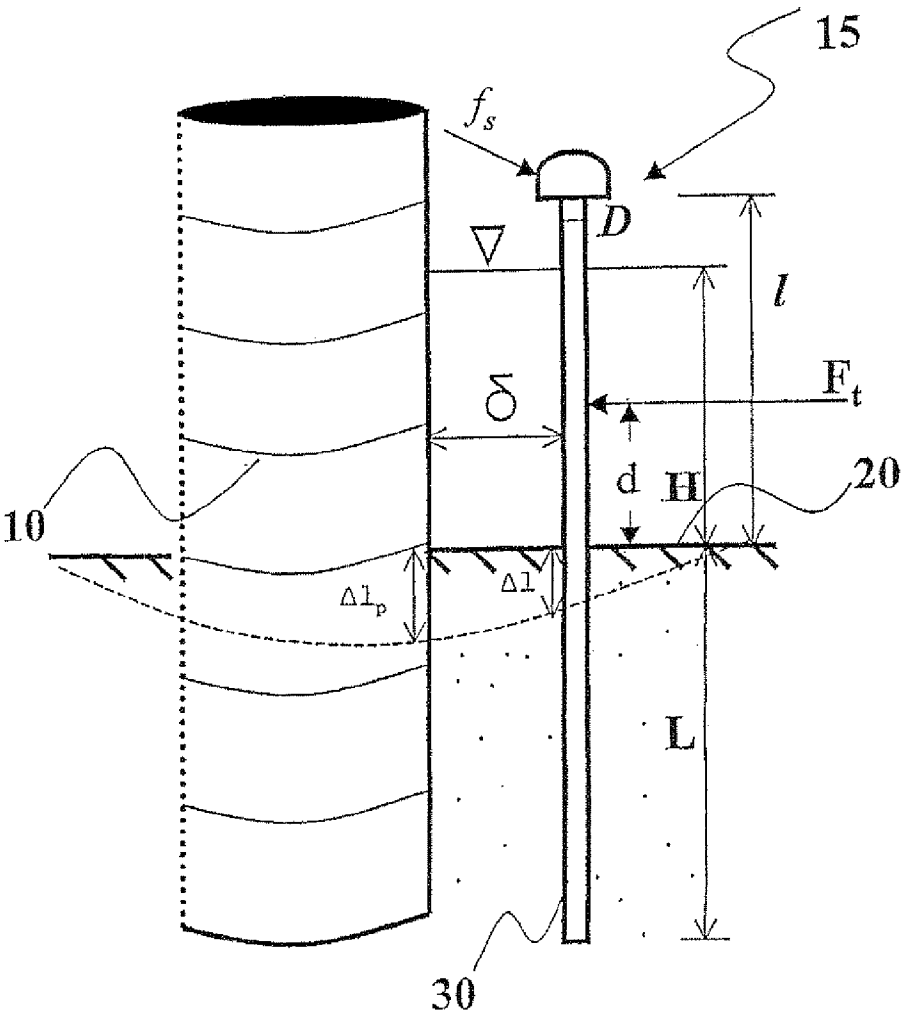
Figure 1:
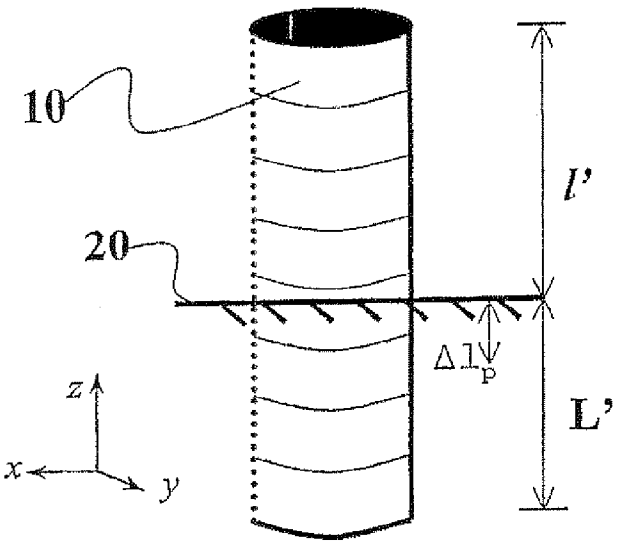
Prior art Fig. 1
Figure 10A:
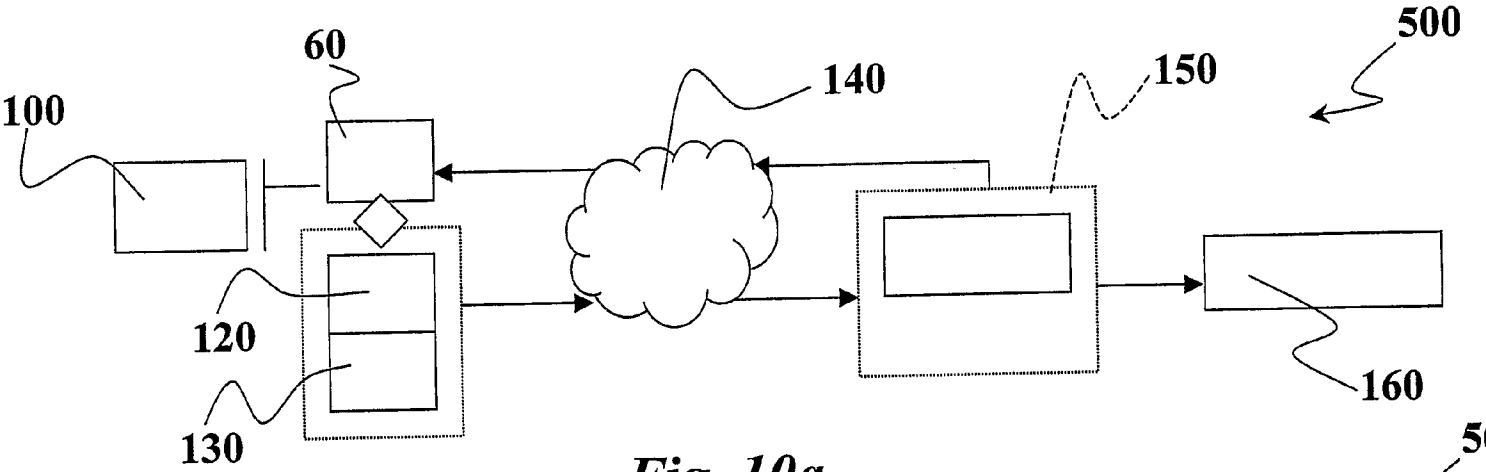
Figure 10B:
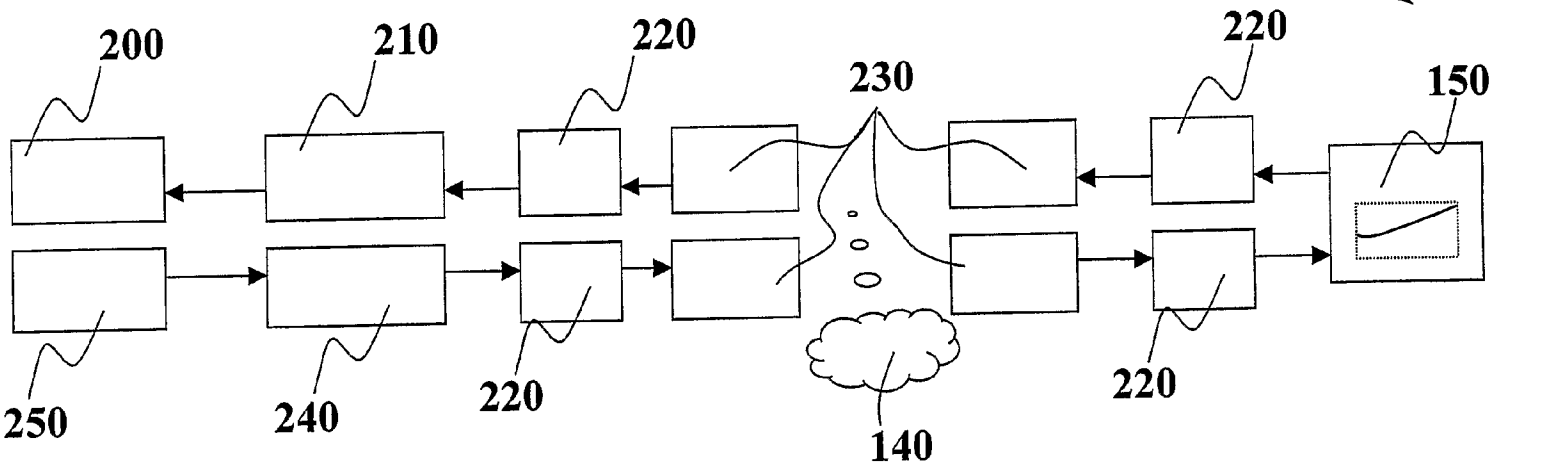
Figure 11A:
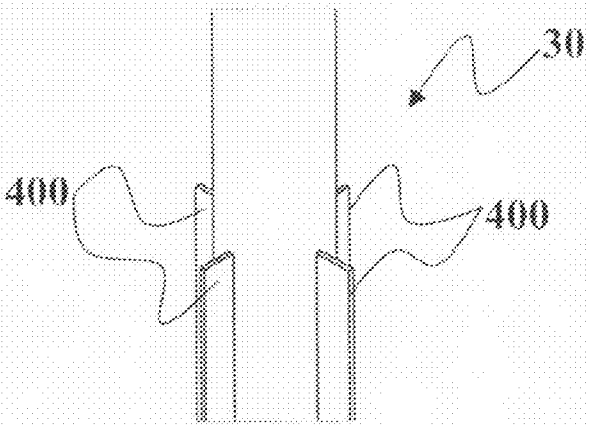
Figure 11B:
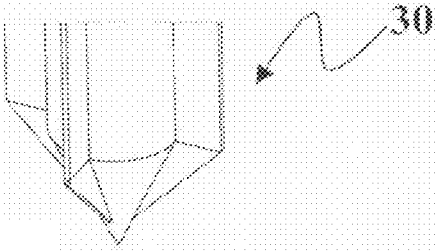
Figure 12:
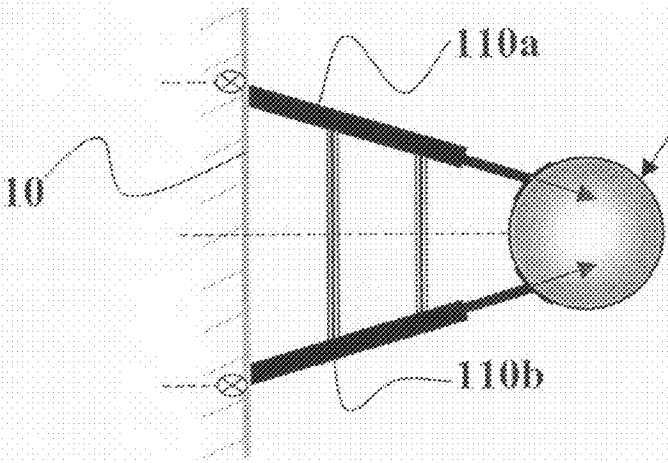

FIGS. 10*a* and 10*b* schematically show a block diagram illustrating the operation of a monitoring system comprising the monitoring element of FIG. 2;

FIGS. 11*a* and 11*b* show additional constructive details of the monitoring element of FIG. 2;

FIG. 12 shows a detail of an embodiment of the monitoring element of FIG. 2.

The monitoring system described herein provides a measurement of the level variation, in particular of the lowering, of portions, or bottom elements, of soil subjected to erosive or sedimentary agents such as the flow of a river or wind. This measurement is performed by means of a monitoring element (also known as probe) embedded in the bottom region. The monitoring system described herein is particularly aimed at monitoring and signalling phenomena which negatively influence the stability of vertical support elements, such as piers or pillars, which sustain hydraulic structures such as bridges. Said vertical support element is monitored to identify the emergence of anomalous conditions which cause said support element to assume unstable positions, which may create problems to the soundness of the supported hydraulic structures.

The proposed monitoring element, in a preferred embodiment, is used in measuring the size of a lowering phenomenon, which is located at the foot of river pillars as a result, for example, of an extraordinary flow condition.

Figure 3B:
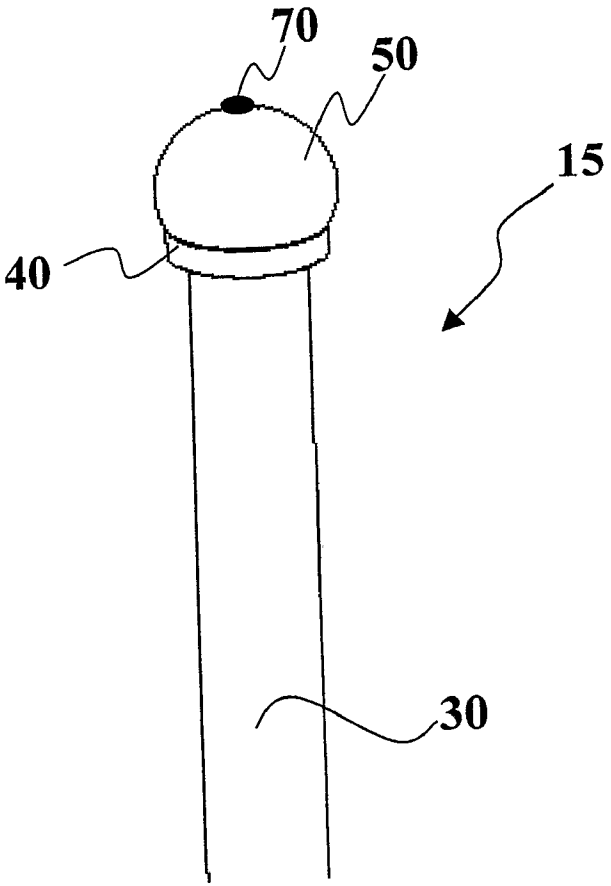
Figure 3A:
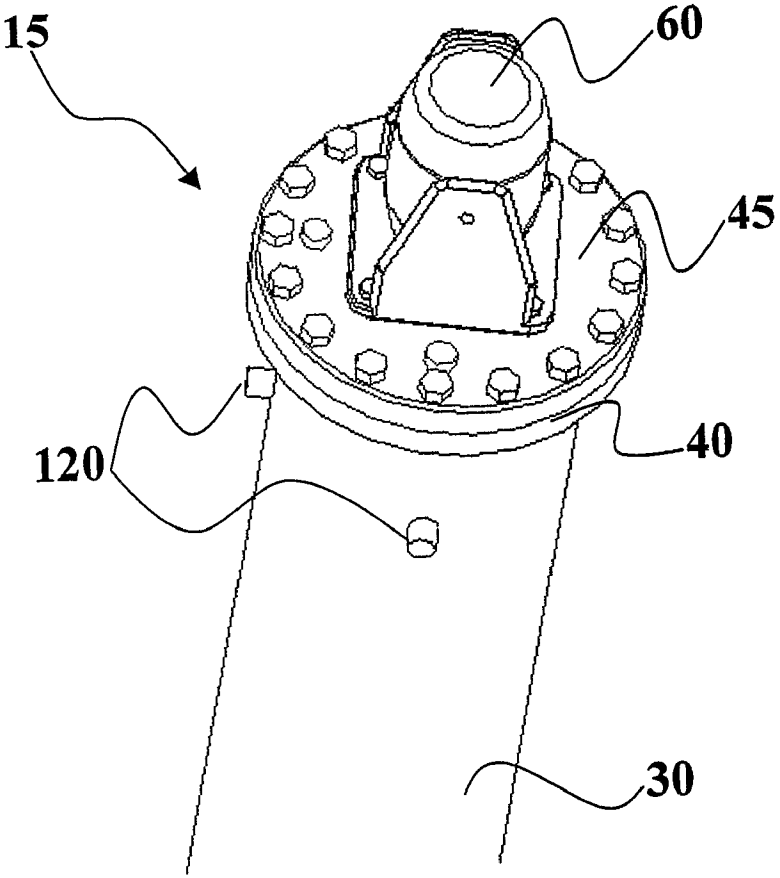

The proposed monitoring element, which constitutes the operative core of a system for monitoring the level variation of a soil subjected to erosive and sedimentary agents, is now described with reference to FIGS. 3*a* and 3*b*. The monitoring element 15, or probe, comprises a section bar 30, on a free end whereof are provided a flange 40 and a loading plate 45 to fasten a covering carter 50 which encloses and protects within it a shaker 60, which, in a preferred version is an inertial shaker, but it can also be obtained with an electromagnetic striker. Said covering carter 50 also comprises, associated to its top, an indicator LED 70. Inferiorly to the flange 40, accelerometers 120 are positioned on the section bar 30, in particular two accelerometers preferably arranged at 90° from each other, as shown in FIG. 3*a*. Alternatively, the accelerometers 120 can be installed inside the sealed case 50 positioned at the top of the section bar 30.

Figure 4:
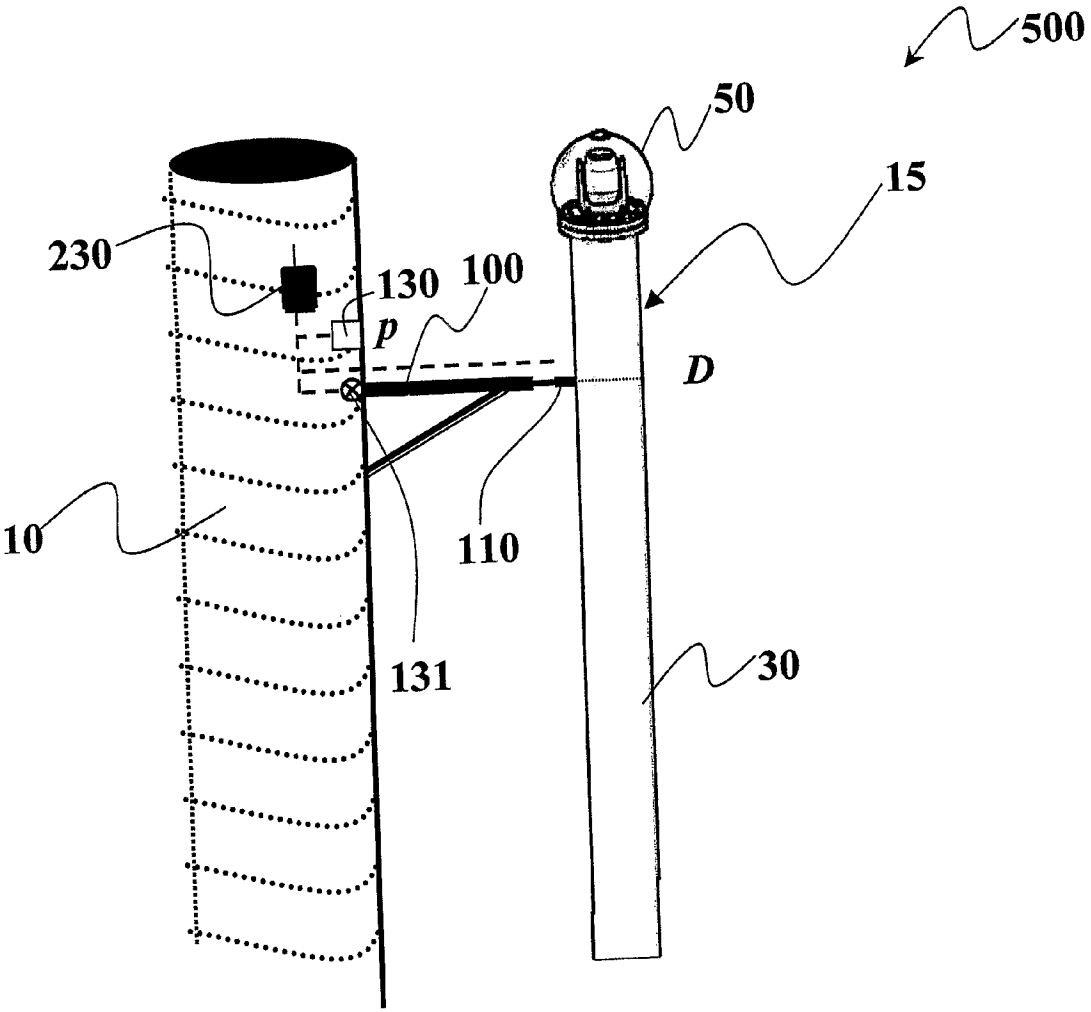
FIG. 4 shows the monitoring system according to the invention in a configuration of use.

FIG. 4 partially shows a monitoring system 500 comprising the monitoring element 15 in operative configuration. It can be observed that the monitoring element 15 is connected by means of cables to a wireless transceiver module 230, which communicates with a control centre 150 (visible in FIG. 5). The values measured by the accelerometers 120 are sent through the transceiver module 230 (which uses, for example, UMTS, GPRS or GSM technology) to a second transceiver unit installed at the remote control centre 150. The measurements taken by the accelerometers 120 can reach the unit 150 also through the Internet network.

Figure 5:
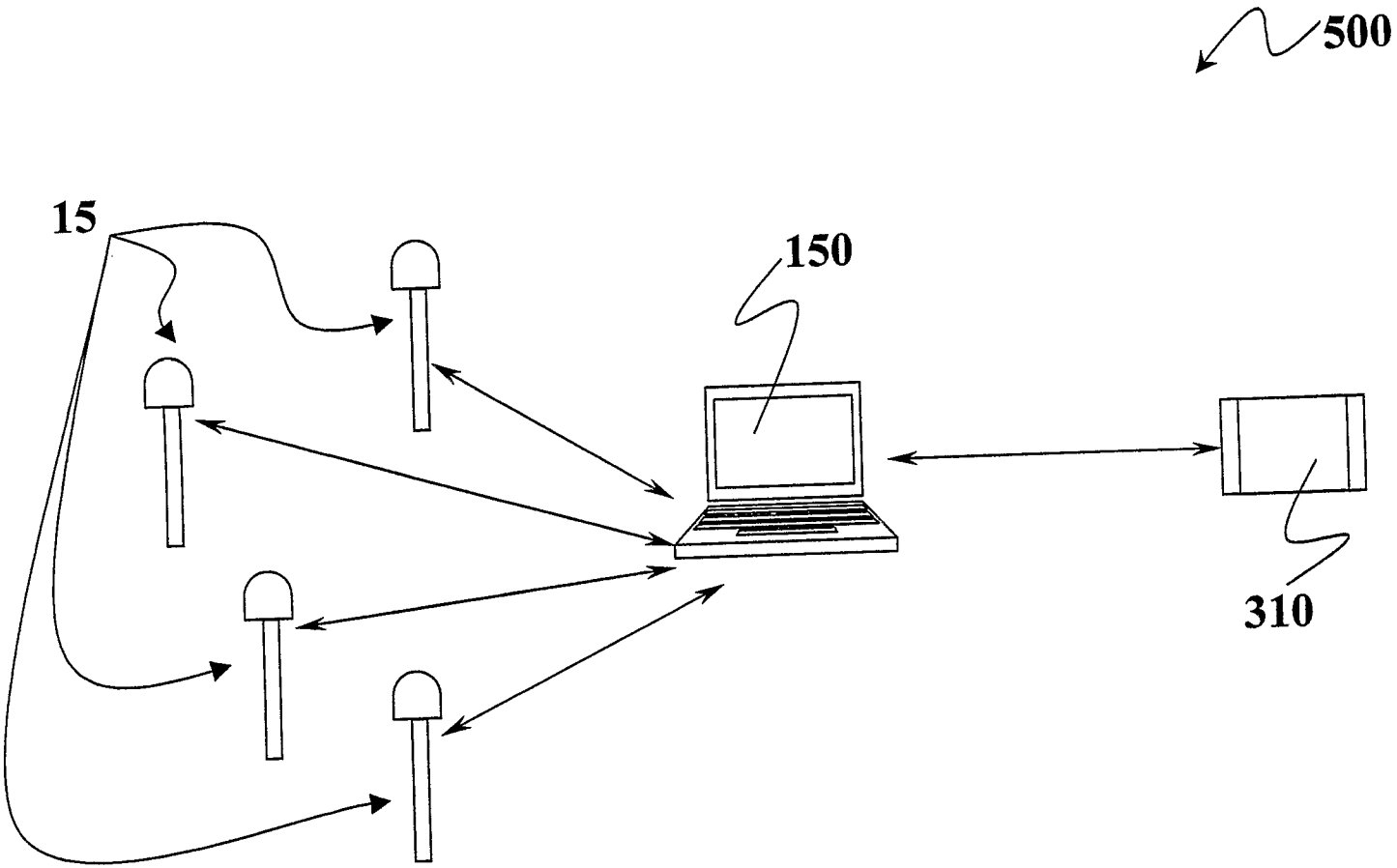
FIG. 5 shows an overall architecture of the monitoring system.

FIG. 5 shows the architecture of the system 500 which comprises, as stated, the remote control centre 150, shared by all or part of a plurality of monitoring elements 15 installed and located in different geographic positions, thereby configuring a control network managed by one or more central units like the remote control centre 150, interfaced directly to the monitoring elements 15 on one side and with control centres 310 corresponding two the agencies tasked with performing safety-related interventions (e.g., Civil Protection) on the other side.

FIG. 4 also shows an actuator 100, which is installed in a point, or vertical co-ordinate, D of the section bar 30 on the pier 10. Said actuator 100 comprises a stem 110 associated with a pressure sensor 130 and a pressure limiter valve 131, whose operation shall be described in further detail hereafter with reference to FIG. 8. The actuator 100 by means of the stem 110, which is extracted to grip the section bar 30, in the point D provides the section bar with a front support to prevent it from drifting towards the pier 10 under the hydrodynamic action of the flow.

FIG. 2 shows the positioning of the monitoring element 15 relative to the pier 10 in terms of distance. The section bar 30 is driven into the soil 20 at a distance δ by the pier 10, laying it underground, for example, by means of a percussive hydraulic device or of guided digging. A free length l is left which depends on a maximum height of the free surface of the water H expected at that point of the watercourse, in order preferably to maintain the monitoring element 15 emerged, so the shaker 60 is easily accessible for maintenance operations (such as checking welds and electrical connections) and to prevent water infiltration as well as the collision of the shaker with heavy solid bodies carried by the flood.

In FIG. 2, the reference $f_s$ designates a force, for example random, acting on the monitoring element 15 and originated by the shaker 60, whilst $F_t$ designates a resulting force due to hydrodynamic action, which operates on the monitoring element 15. The point D where the actuator 100 is positioned on the section bar 30 is indicated as a distance from the bottom 20.

The monitoring element) 15 measures the depression Δl of the level of the bottom 20 by evaluating typical frequencies $\lambda_i$ of the material system constituted by the monitoring element 15 stressed by the shaker 60 or striker.

The shaker 60 serves the purpose of stressing the section bar 30 with a force that, for example, can be random, with assigned spectrum and such as to capture, by means of the measurements taken by the accelerometers 120, a certain number of resonant frequencies of the monitoring element 15, to enable deriving, from said resonant frequencies, the natural frequencies (of the monitoring element 15) and from them the depression Δl of the bottom 20 of the monitoring element 15, which shall be slightly smaller than the lowering $\Delta l_p$ of the pier 10, as shown for example in FIG. 2, where the dashed line represents the bottom 20 dug by the water flow. The accelerometers 120 form the core of the monitoring element 15.

As is well known from Eulero-Bernoulli's theory, the natural frequencies $\lambda_i$ of a beam, whereto the monitoring element 15 can be approximated, are inversely proportional to the square of the free length l of the section bar 30, as indicated by the Eulero-Bernoulli law:

$$\lambda_i = \frac{\beta_i^2}{l^2}\sqrt{\frac{EI_y}{\rho A}} \tag{1}$$

where:

ρ represents a density of the section bar 30,

E represents a coefficient of elasticity of the section bar 30, $I_y$ represents a moment of inertia of the section bar 30, A represents a surface area of the axial section of the section bar 30.

Moreover, $\beta_i$ represents constants, present in the equation (1), which depend on constraint conditions. In the case of element with set-free constraint, the values shown in the following table apply:

| | Modes | | | | | |
|---|---|---|---|---|---|---|
| | i = 0 | i = 1 | i = 2 | i = 3 | i = 4 | i > 4 |
| $\beta_i$ | — | 1.875 | 4.694 | 7.855 | 10.996 | (i − ½)Π |

The natural frequencies $\lambda_i$ thus depend on the mechanical characteristics of the body (E, ρ), on its shape (A, l, $I_y$), and on the boundary conditions (constraint). The monitoring system described herein therefore allows continuously to derive the depression Δl by experimentally measuring said natural frequencies $\lambda_i$, since from the measurement taken by the accelerometers 120 one derives the resonant frequencies (designated as $\lambda^*_i$ in the acquisition chart shown in FIG. 7) and from them the natural frequencies $\lambda_i$, which thus allow indirectly to determine the free length of the section bar 30 and hence the level of the bottom 20, as indicated in equation (2):

$$l = \sqrt{\frac{\beta_i^2}{\lambda_i}\sqrt{\frac{EI_y}{\rho A}}} \tag{2}$$

The underground length L of the section bar 30 (also called piled portion) secures the monitoring element 15 to the bottom 20. The decrease in said underground length L (by effect of the rise of the material caused by erosion) causes the free length l of the section bar 30 to increase and hence changes the value of the natural frequencies of the system: natural frequencies change from the values $\lambda_i$ to new values $\overline{\lambda_i}$ and undergo a reduction. The monitoring system is configured to interpret said change in the vibrational behaviour of the monitoring element 15 as a change in the level of the bottom from the free length l to a new free length $\bar{l}$, where the new length $\bar{l}$ is expressed by the following equation:

$$\bar{l} = \sqrt{\frac{\beta_i^2}{\overline{\lambda_i}}\sqrt{\frac{EI_y}{\rho A}}} \tag{3}$$

Starting from equations (2) and (3) it is then possible to calculate the value of the depression Δl of the bottom 20 which is equal to the difference of the new length $\bar{l}$ with respect to the free length l, i.e. $\Delta l = \bar{l} - l$.

Equations (2) and (3) are evaluated by sending the values measured by the accelerometers 120 as stated, to the transceiver module 230 and thence to the remote control centre 150. The data are subsequently acquired by a computer in which are implemented the vibrational models of the monitoring element 15 and of the constraint. The results are summarised and represented by traces on monitors which show the profile over time of the natural frequencies and consequently of the level of the bottom 20. Beyond a certain limit of the value of depression Δl, the monitoring system informs, e.g. an operator, that the stability of the structure is in peril hazard because the foundations of the pier 10 are being undermined from the bottom 20.

The structural base of the model applied in the control centre 150 is the study of the flexural behaviour of the monitoring element 15 with the classic Eulero-Bernoulli approach (homogeneous and prismatic beam) based on the hypotheses that both shear strain and inertia to rotation are negligible if compared to flexion strain and translation inertia. The constraint of the monitoring element 15 is modelled taking into account the modulus of elasticity $E_t$ of the bottom 20 and of the underground length L of the section bar 30. The physical presence of the shaker 60 is modelled by introducing a dynamic condition at the top.

The model takes the form of the following system of equations:

$$\begin{cases} 1y)\ \ \rho A\dfrac{\partial^2 u_y}{\partial t^2} + EI_x\dfrac{\partial^4 u_y}{\partial z^4} = -k_t u_y & \text{for } z < L \\ 2y)\ \ \rho A(1+\varphi c)\dfrac{\partial^2 u_y}{\partial t^2} + EI_x\dfrac{\partial^4 u_y}{\partial z^4} = D_y(z,t) & \text{for } L < z < L+H \\ 3y)\ \ \rho A\dfrac{\partial^2 u_y}{\partial t^2} + EI_x\dfrac{\partial^4 u_y}{\partial z^4} = 0 & \text{for } z > L+H \end{cases} \tag{4}$$

where $D_y(z,t)$ represents resistance in the direction y (which on average is nil).

The boundary conditions imposed along the direction y are the following:

$$\begin{cases} ay)\ \ T_y + f_s(t) = EI_x\dfrac{\partial^3 u_y}{\partial z^3} + f_s(t) = m*\dfrac{\partial^2 u_y}{\partial t^2} & \text{for } z = L+l \\ by)\ \ M_x = EI_x\dfrac{\partial^2 u_y}{\partial z^2} = 0 & \text{for } z = L+l \\ cy)\ dy)\ \ T_y = M_x = 0 \Rightarrow \dfrac{\partial^3 u_y}{\partial z^3} = \dfrac{\partial^2 u_y}{\partial z^2} = 0 & \text{for } z = 0 \end{cases} \tag{5}$$

One could similarly write the system of equations for the direction x, in which $\phi = (\rho_f/\rho)$ and c is the function of the shape of the axial section of the section bar 30 with respect to the influence of the added mass of fluid around the same section bar 30.

The definitions of the parameters present in the previous system of equations (4) and in the system of surrounding conditions (5) are provided below.

$k_t = k_t(E_t, D, z)$ is the elastic constant of the soil 20, $\rho_f$ is the density of the fluid;

ρ is the density of the section bar 30;

E is the modulus of elasticity of the section bar 30;

$f_s(t)$ is the force of the shaker 60;

$I_y$ is the moment of inertia of the section bar 30;

H is the height of the free surface of the current;

A is the surface area of the axial section of the section bar 30;

$U_\infty$ is the velocity of the flow at infinity;

$C_d$ is the diffusion coefficient;

Re is the Reynolds number;

De=2R is the diameter of the section bar 30;

m* is the mass of the shaker 60 and of the superstructure;

$u_y(z,t)$ is the longitudinal displacement of the axial section of the section bar 30;

$T_{x,y}$ is the shear in the axial section; and $T_{x,y}$ is the flexing moment in the axial section.

The height H can be measured automatically by the system, e.g. using a photo camera, or it can be introduced manually by an operator.

Naturally for $k_t \rightarrow \infty$ an infinitely rigid setting is obtained in A and the Eulero-Bernoulli results described above to show how natural frequencies change with the length of the section bar.

It is readily apparent that a code based on the Finite Elements Method (FEM) is particularly well suited to describe, under these conditions, the vibrational behaviour of the monitoring element 15 (probe). Farther on in the disclosure, an example of analysis according to the FEM method is described in detail.

In the numerical model are evaluated the presence of an influencing additional mass of fluid around the monitoring element 15, and the action of the fluid on the section bar 30 and on its frequency response to the excitation of the shaker 60. The distance $\delta$ of the monitoring element 15 from the wall of the pier 10 introduces in the code a correction factor $\eta$ (to be evaluated, for example, experimentally) to match the undermining of the section bar 30 with that of the pier 10.

However, for the calculation of natural frequencies alone, it is redundant to consider the action of the shaker 60 and the dynamic action of the fluid.

Figure 6:
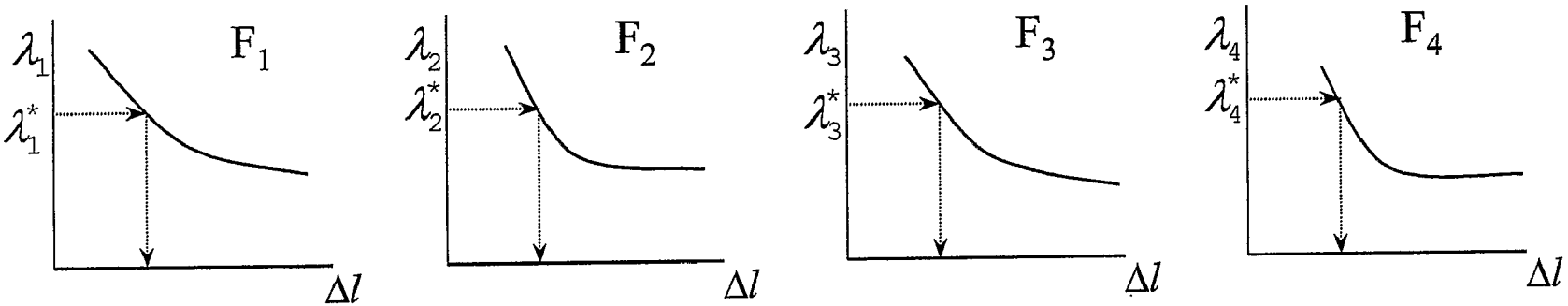
FIG. 6 shows a diagram of frequencies of the monitoring element of FIG. 2.

The result of the finite element calculation of the monitoring element 15 is illustrated in four charts, shown in FIG. 6, which represent curves $F_i$, respectively $F_1$, $F_2$, $F_3$ and $F_4$, relating to the respective first four natural frequencies $\lambda_i$ assigned parameters as a function of the depression $\Delta l$.

Figure 7:
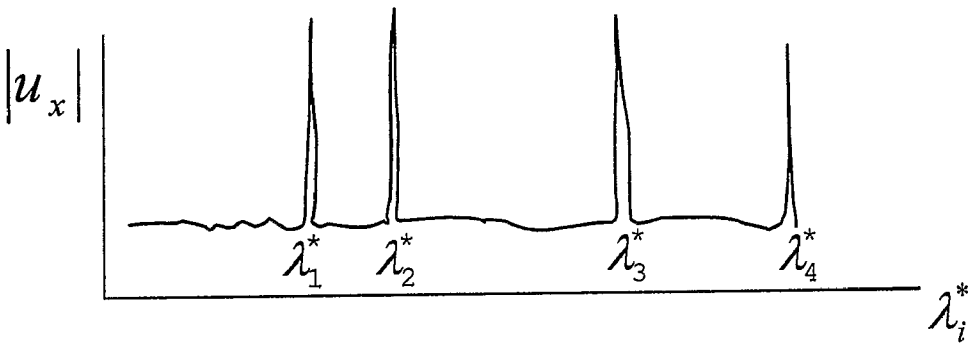
FIG. 7 shows a diagram illustrating displacements of the monitoring element of FIG. 2.

Exciting the section bar 30 by means of the shaker 60, the accelerometers 120 measure the accelerations of the monitoring element 15 whence, through a Fourier transform, the resonant frequencies of the monitoring element 15 are obtained, thereby providing the experimental chart shown in FIG. 7, which represents the modulus $|u_x|$ of the Fourier transform of the displacements, highlighting the first four resonant frequencies from which can be obtained the natural frequencies: four experimental natural frequencies $\lambda^*_i$ are thereby obtained.

Using the four experimental natural frequencies $\lambda^*_i$ thereby obtained and the charts related to the curves $F_i$ shown in FIG. 6 it is possible to determine a corresponding experimental value of depression $\Delta l^*$. If the depression $\Delta l^*$ is greater than a limit threshold $\Delta l_{lim}$, the system provides an alarm.

To evaluate the modulus of elasticity $E_t$ of the soil 20, a load-less test can be used, whereby the monitoring element 15 is installed, the shaker 60 is activated and, through the accelerations measured by the accelerometers 120, measuring the natural frequencies $\lambda_i^0$ of load-less response of the monitoring element 15. From these measures, one can derive the modulus of elasticity $E_t$ of the soil 20, since it represents, the sole unknown, the geometry being completely; known.

From Eulero-Bernoulli's equation (1) applied to the case of the load-less test of the system, one obtains the equation (6):

$$\lambda_i^0 = \frac{\beta_i^2}{l_0^2}\sqrt{\frac{EI_y}{\rho A}} \tag{6}$$

in which the sole unknown is the constant $\beta_i$ which depends on the type of constraint and, hence, in this case, on the modulus of elasticity $E_t$. The value of the modulus of elasticity $E_t$ is then used in the Finite Element code.

With reference to FIG. 4, a pressure value p provided by the pressure transducer 130 is used to evaluate the resulting force $F_t$ of the action of the fluid on the section bar 30. Using, in this case as well, the Finite Element Method, the equivalent structure is solved:

$$u_{xD}=0 \tag{7}$$

where the equation (7) is the cinematic congruence equation.

Figure 8:
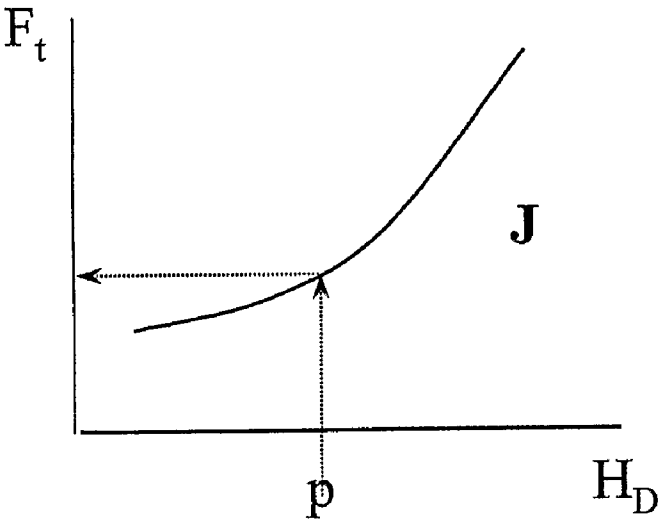
FIG. 8 is a diagram illustrating a force of the fluid acting on the monitoring element of FIG. 2.

An arm d of the resulting force $F_t$ relative to the bottom 20 is evaluated taking account the vertical profile of the velocity of the flow. FIG. 8 shows a chart of a curve J of the resulting force $F_t$ as a function of a force $H_D$ which is exerted on the actuator 100 in the point D, i.e. $F_t=F_t(H_D)$.

The actuator 100 in the point D provides the section bar 30 with a frontal support to prevent the section bar from drifting towards the pier 10 under the hydrodynamic action of the water flow.

The pressure value p measured by the transducer 130 corresponds in fact to the force $H_D$ which is exerted on the actuator 100. Starting from said force $H_D$ the mean resulting force $F_t$ is determined, and therefrom a force on the pier 10. Having available, from the resolution of the static equations of the structure, also the curves that provide the dependence of the constraint reactions of the bottom on the force $H_D$:$H_A=H_A(H_D)$ (horizontal reaction of the bottom 20) and $M_A=M_A(H_D)$ (moment of the bottom 20), the constraint reactions to the bottom 20 are determined.

Knowledge of these constraint reactions allows a further evaluation of the modulus of elasticity of the soil $E_t$. Knowing the resulting force $F_t$, based on the curve J of FIG. 8, the velocity of flow at infinity $U_\infty$ is determined with the following equation:

$$2F_t = \int_0^H C_d(\mathrm{Re})\rho_f U_\infty^2 D\,dz \tag{8}$$

imposing to velocity, for example, a logarithmic profile. This velocity is the one introduced in Finite Element processing.

Figure 9:
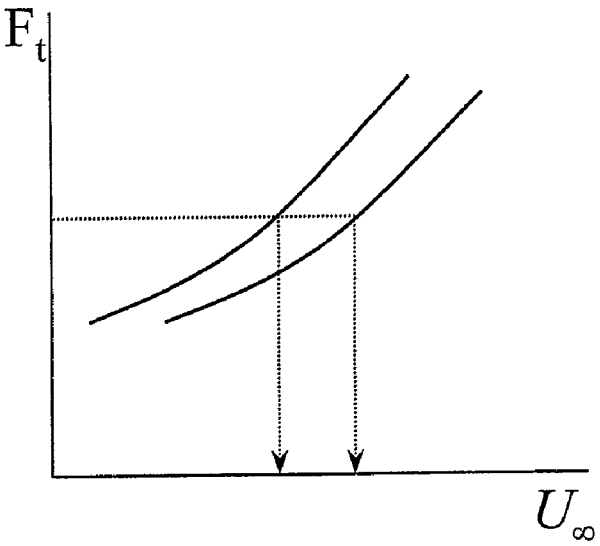
FIG. 9 is an additional, diagram illustrating a force of the fluid acting on the monitoring element of FIG. 2.

FIG. 9 shows the chart of the resulting force $F_t$ as a function of the velocity of the flow at infinity $U_\infty$. The band in FIG. 9 takes into account the aleatory degree of the measurement of the density of the fluid $\rho_f$ due to solid transport.

Actually, the section bar 30 is in the flow region that is perturbed by the presence of the pier 10 and hence the equation that takes this perturbation into account is the following, and it describes the resulting force due to the hydrodynamic action:

$$F_t = \sigma\int_0^H C_d(\mathrm{Re})\rho_f U_\infty^2 D\,dz \tag{9}$$

with $\sigma<1$ evaluated experimentally.

From the dynamic viewpoint, to have the dimensioning of the shaker 60 one numerically resolves the system that describes the model imposing a maximum displacement $u_{yMAX}$ of the free end of the monitoring element 15, end that is positioned in (z=L+l), and a random excitation with a maximum value $F_s$: $f_s(t)=\mathrm{random}(F_s)$ The maximum value $F_s$ is thereby obtained which causes the maximum displacement $u_{yMAX}$.

The maximum displacement $u_{yMAX}$ imposed must be such as to maintain the structure and the bottom in the elastic range.

In regard to the dimensioning of the actuator 100, in the model a maximum stress is imposed which is due to the resulting force $F_t$ relating to the hydrodynamic action and the force $H_D$ is determined which is exerted on the actuator 100 (curve J in FIG. 8).

One can introduce in the model an excitation $f_s(z, t)$ which simulates a collision with a heavy object:

$$f_s(z,t)=F_M\delta(z-(L+H))\delta))\delta \tag{10}$$

Equation (10) represents an impulse of modulus $F_M$ which is concentrated at the free surface. The force exerted on the actuator 100 is thus determined, and the pressure limiter valve 131 is calibrated correspondingly.

If the monitoring device 15 is hit by a solid object that is so heavy as to compromise the structural integrity of the actuator 100, the pressure limiter valve is activated, allowing the retraction of the stem 110 of the actuator 100 which is extracted to grip the section bar 30.

In regard to the dimensioning of the section bar 30, said section bar 30 is hollow with circular section. An external diameter De of the section bar 30 is chosen on the basis of considerations concerning the stability of the monitoring device 15 and it depends on the type of soil and on the maximum expected flow rate.

The critical section is the low terminal section of the free end. This is calculated in classic manner comparing the maximum stresses obtained from the model with the yield stress of the material.

The section is stressed by straight flexion and the consequent strain will be:

$$\sigma_{zMAX} = \frac{F_t d + F_s l}{\frac{\Pi}{4}(R^4 - r^4)} R \Rightarrow f(\sigma_{zMAX}) < \sigma_p \tag{11}$$

where R is the outer radius and r the inner radius of the circular section bar 30.

In case of impact the equation (11) is transformed as follows:

$$\sigma_{zMAX} = \frac{F_M l}{\frac{\Pi}{4}(R^4 - r^4)} R \Rightarrow f(\sigma_{zMAX}) < \sigma_p \tag{12}$$

Setting the outer diameter D=2R, the value of the inner radius r is determined.

FIGS. 10*a* and 10*b* shows the logic diagram of operation of the monitoring system 500. In particular, FIG. 10*a* is a block diagram representing in block form the actuator 100, the shaker 60, the set of accelerometers 120, and pressure transducer 130, already described above. A wireless connection, which embodies for example the transceiver unit 230 of FIG. 4, between the monitoring element 15 and the control centre 150 is designated by the reference number 140. Inside the control centre 150 is implemented the processing of the model (e.g., equations (4) and (5)) which describes the system relating to the monitoring element 15. The output of the control centre 150 is represented by a report 160, electronic or hard copy, comprising the quantities Δl, $F_t$, $E_t$, $U_\infty$.

In FIG. 10*b*, in an additional block diagram are shown other components of the monitoring system.

The reference number 250 designates the set of accelerometers 120 and the pressure transducer 130 which provides its signal to a compensation stage 240, followed by an adaptation stage 220 for radio transceiver unit 230 which transmits on the wireless network 140 to the remote control centre 150, through a transceiver unit 230 and an adaptation stage 220 associated thereto.

The remote control centre 150 is able, through an adaptation stage 220 and a transceiver unit 230, to transmit commands on the wireless network 140, which are received, on the side of the monitoring element 15, by a corresponding transceiver unit 230 and adaptation stage 220, which forward the commands to a controller 210 to control the set of the shaker 60 and of the actuator 100, globally indicated by the reference 200.

In general, the monitoring system 500 operates as follows. The monitoring system 500 is normally off. At the moment the system 500 is powered, the stem 110 of the actuator 100 is in an extracted condition and gripping the section bar 30 with a minimum pressure $P_{min}$ in such a way as to assure a secure contact. In these conditions, the information sent to the remote control centre 150 is the only measurement of the transducer 130 of the pressure p which the code uses to evaluate the force exerted by the fluid on the section bar 30 and hence on the pier 10.

At time intervals Δt the stem 110 is retracted, hence the shaker 60 is commanded to stress the section bar 30, so that the accelerometers 120 can take the measurements to determine the experimental natural frequencies $\lambda^*_i$. The measurements of these accelerometers 120 are transmitted, through the units 230, to the remote control centre 150 which determines the state of the depression Δl of the bottom 20 applying the model described above. Once the vibration imparted by the shaker 60 is extinguished, the stem 110 returns to its gripping condition. This procedure is completely automatic.

The test parameters (time interval Δt, parameters of the shaker 60) can be changed by the operator in the remote control centre 150. The physical location of said remote control centre can be in any geographic point reached by the UMTS or GPRS signal; the control and computation unit can be portable, e.g. by means of PC tablet provided with transceiver and acquisition cards, in order to be usable also in motion. The output results can be transmitted, for information, to palmtops or cell phones of special users authorised to receive these data. There can also be a micro-camera, which shoots the processes (also checking the level H of the free surface) and sends images to the control centre 150 through the transceiver units 230.

The accelerometers 120 can measure vibrations also independently of the activation of the shaker 60, thereby measuring the background noise produced by the action of the flow on the monitoring element 15.

In principle, these stresses generated by the flow could be sufficient to determine the natural frequencies of the monitoring element 15. However, in fact, their intensity and spectral distribution, which depend on the conditions of the flow in the river, may not be sufficient to accurately determine their natural frequencies $\lambda^*_i$ and to draw reliable conclusions on its vibrational behaviour. The monitoring element 15 is preferably tested reproducing the lowering of the soil and the change in water level. These tests are aimed at introducing experimental correction coefficients of the model: therefore the shaker 60 is activated modulating the depression Δl and comparing the natural frequencies $\lambda^*_i$ measured by the accelerometers 120 with those calculated by the model.

Additional variations to the monitoring device, system and method described hitherto are possible.

The dimensions of the section bar 30 can be reduced placing the unit that houses the shaker 60 under the free surface and armouring it.

Moreover, it may be useful to provide a modular structure of the monitoring element 15 with a first part of section bar 30 positioned underground and secured thereto a second part with shaker 60 and accelerometers 120.

The unit 230 installed on the bridge may not be present, thus positioning the electronic components relating to the units 230, 240, 220, 210 inside the case 50. The processing unit may also be conveniently located aboard the monitoring element or otherwise at the side, with respect to the connection 140, of the monitored structural element, in order to reduce the information sent to the remove control centre 150 only to the report 160. Moreover, the system can be configured to interface directly with a light indicator (traffic light) positioned at the entrances to the bridge, thereby directly preventing users to cross the bridge when it is in hazardous conditions. In this case, the wireless communication with the remote control centre 150 need not be present.

In another possible configuration, the section bar is doubly fastened: to the bottom and to the pier itself.

The front bearing of the section bar 30 onto the pier 10 can also be double, with two stems 110*a* and 110*b* appropriately inclined as shown in FIG. 12.

The actuator 100 and the related components (pressure transducer, pressure limiter valve . . . ) may also not be present.

Based on the flow, the monitoring elements 15 may be provided with a different profile from the constant straight annular section. The underground length L can have a different axial section from straight circular; for example, as shown in FIG. 11*a*, it can be provided with "tongue" 400 to improve its stability. The low end of the monitoring element 15 can instead be pointed, as shown in FIG. 11*b*, to facilitate its installation in the soil 20.

The monitoring system described above is thus advantageously able to operate on the operator external request (on command) and continuously, by virtue of the shaker positioned on the monitoring element.

Advantageously, the monitoring system described above is not invasive for the environment or harmful for fish species and for the flora which inhabit the body of water.

The monitoring system is also able to measure a "hidden undermining", difficult to evaluate with optical or acoustic systems, i.e. an undermining in which the bottom has not dropped significantly but is not completely planted due, for example, of the mud that has replaced part of the material around the pillar.

More in general, the monitoring system described above is advantageously able to evaluate the loss of stability of works which are subjected to conditions of possible lowering of the bottom whereto they are secured: bridges, girders, marine works and hydraulic constructions in general.

An example of application of FEM method for computing natural frequencies shall now be described in greater detail.

Applying Galerkin's method to the equation of the quantity of motion in the direction y (1y, 2y, 3y) in the absence of resistance and without forcing the shaker, and designating with the reference letter G the space of the sufficiently regular functions g(z) defined in (0, L+l=T) which meet the surrounding conditions of the physical model, one has:

$$\rho A\int_0^T \partial_t^2 u_y g\,dz + \rho A\varphi c\int_L^{L+H} \partial_t^2 u_y g\,dz + EI_x\int_0^T \partial_z^4 u_y g\,dz + \int_0^L k_t(z) u_y g\,dz = 0 \quad \forall\, g \in G$$

$$\rho A\int_0^T \partial_t^2 u_y g\,dz + \rho A\varphi c\int_L^{L+H} \partial_t^2 u_y g\,dz + EI_x\int_0^T \partial_z^2 u_y \partial_z^2 g\,dz + \int_0^L k_t u_y g\,dz + EI_x\left[\partial_z^3 u_y \partial_z g\Big|_0^T - \partial_z^2 u_y \partial_z g\Big|_0^T\right] = 0$$

$$\rho A\int_0^T \partial_t^2 u_y g\,dz + \rho A\varphi c\int_0^{L+H} \partial_t^2 u_y g\,dz + EI_x\int_0^T \partial_z^2 u_y \partial_z^2 g\,dz +$$

-continued $$\int_0^L k_t u_y g\,dz + m * \partial_t^2 u_y(T, t) g(T) = 0$$

meeting $\forall g \in G$ with $u_y(z, t)$ exact solution.

Let us introduce a subspace $G_N$ of dimension N whose base is constituted by the functions $\phi_i$. Imposing that the numeric solution must meet the last equation only for g belonging to $G_N$, and hence for each of the base functions, one has:

$$\rho A\int_0^T \partial_t^2 u_y^N \varphi_i\,dz + \rho A\varphi c\int_0^{L+H} \partial_t^2 u_y^N \varphi_i\,dz + EI_x\int_0^T \partial_z^2 u_y^N \partial_z^2 \varphi_i\,dz + \int_0^L k_t u_y^N \varphi_i\,dz + m * \partial_t^2 u_y^N(T, t)\varphi_i(T) = 0$$

for every i from 1 to N.

Let $u_y^N$ be the numeric solution projection of $u_y$ in the subspace $G_N$:

$$u_y^N \in G_N \subset G,\ u_y \sim u_y^N = \sum_{i=1}^N q_j(t)\varphi_j(z)$$

Replacing the expression of $u_y^N$, one has:

$$\sum_{j=1}^N M_{ij} q_j''(t) + \sum_{j=1}^N K_{ij} q_j(t) = 0$$

where the matrices Mij and Kij, which respectively represent the mass matrix and the global rigidity matrix, are given by:

$$M_{ij} = \rho A\left(\int_0^T \varphi_i\varphi_j\,dz + \varphi c\int_L^{L+H} \varphi_i\varphi_j\,dz\right) + + m * \varphi_j(T)\varphi_i(T)$$

$$K_{ij} = EI_x\int_0^T \varphi_i''\varphi_j''\,dz + \int_0^L k_t\varphi_i\varphi_j\,dz$$

The basic functions $\phi_i$ of the Finite Element Method are now be defined; they shall be third degree polynomials in segments on each of the Ne elements into which the entire structure is subdivided. The number of the elements $N_e$ is given by the number of the underground elements $N_t$ plus the number of free elements $N_l$ $$N_e = N_t + N_l$$

$$N = 2N_e + 2$$

The mass and rigidity matrices Mij are Kij are calculated adding the local mass and rigidity matrices of each finite element.

The numeric natural frequencies of the material system are now calculated solving the equation:

$$det(\underline{\underline{Kij}} - \omega^2 \underline{\underline{Mij}}) = 0.$$

and their dependence on the elastic characteristics of the soil and of the sinking Δl.

The introduction into the model of the external stresses due to the fluid and to the shaker is necessary to simulate the frequency response but it is irrelevant for the purposes of evaluating the natural frequencies.

The presence of an additional constraint (retractable support in the point D) is modelled by the related boundary condition (cinematic congruence).

In any case, independently of the construction of a physical and numeric model, the system signals the lowering of the level of the bottom by detecting the variation in the natural frequencies of the material system constituted by the element 15.

The invention claimed is:

1. A system for monitoring level variations of at least one bottom region (20) of a soil subjected to erosive and sedimentary agents, which comprises at least one monitoring element (15) secured to said bottom region (20) ,said at least one monitoring element (15) comprising sensor means (120) to detect a response ($|u_x|$) of said at least one monitoring element (15) with respect to a stress ($f_s$), wherein said stress ($f_s$) is applied to said monitoring element (15) to determine vibrations originating displacements ($|u_x|$) of at least part of said at least one monitoring element, said response detected by said sensor means is a function of said displacements ($|u_x|$) of at least part of said at least one monitoring element (15) and that means (150) are provided for analysing said response with respect to a stress ($f_s$) applied to said monitoring element (15), identifying in said response characteristic frequencies ($\lambda_i$*) of the displacements of said monitoring element (15) and correlating said characteristic frequencies ($\lambda_i$*) with a lowering ($\Delta l_p$) of said bottom region (20) .

2. System according to claim 1, wherein said operation of monitoring level variations of a bottom of a soil subjected to erosive and sedimentary agents comprises monitoring the stability of at least one support element (10), in particular a bridge pier, with respect to said bottom region (20) whereto said support element (10) is secured, said monitoring element (15) being positioned externally to said support element (10).

3. System according to claim 1, wherein said monitoring element (15) comprises actuator means (60) able to be commanded to apply said stress ($f_s$) to said monitoring element (15).

4. System according to claim 1, wherein said mechanical stress is applied by the hydrodynamic action of the fluid.

5. System according to claim 3, wherein said sensor means (120) are accelerometers.

6. System according to claim 3, wherein said actuator means (60) comprise a shaker.

7. System according to claim 1, wherein the system comprises means for receiving and transmitting data (230) pertaining to said response ($|u_x|$) to said stress ($f_s$) of the information to a control centre (150).

8. System according to claim 7, wherein said control centre (150) is positioned remotely.

9. System according to claim 7, wherein said receiving and transmitting means (230) are wireless, in particular receiving and transmitting means for mobile telephony.

10. System according to claim 7, wherein said receiving and transmitting means (230) transfer the data through the Internet.

11. System according to claim 1, wherein the system comprises an actuator (100) which can be activated selectively to reach a bearing position of said monitoring element (15).

12. System according to claim 11, wherein the system comprises a pressure transducer (130) to measure a pressure (p) applied on said monitoring element (15).

13. System according to claim 12, wherein said actuator (100) is associated to a limiter valve (131) operating as a function of said pressure (p) whereto is subjected said monitoring element (15).

14. A method for monitoring level variations of at least one bottom region (20) of a soil subjected to erosive and sedimentary agents, which comprises the operations of:

positioning at least one monitoring element (15) secured to said bottom region (20);

detecting with sensor means (120) positioned in said at least one monitoring element (15) a response ($|u_x|$) of said at least one monitoring element (15) with respect to a stress ($f_s$);

wherein said stress ($f_s$) is applied to said monitoring element (15) to determine vibrations originating displacements ($|u_x|$) of at least part of said at least one monitoring element, and in that it comprises the operations of:

detecting by said sensor means (120) said response as a function of said displacements ($|u_x|$) of at least part of said at least one monitoring element (15);

analysing (150) said response with respect to a stress ($f_s$) applied to said monitoring element (15);

identifying in said response characteristic frequencies ($\lambda_i$*) of the displacements of said monitoring element (15); and correlating said characteristic frequencies ($\lambda_i$*) with a lowering ($\Delta l_p$) of said bottom region (20).

15. Method according to claim 14, wherein said operation of monitoring level variations of at least one bottom region (20) of a soil subjected to erosive and sedimentary agents comprises monitoring the stability of at least one support element (10), in particular a bridge pier, with respect to said bottom region (20) whereto said support element (10) is secured and to position said at least one monitoring element (15) externally to said support element (10).

16. Method according to claim 14, wherein the method comprises the operation of applying said stress ($f_s$) to said monitoring element (15) with controllable actuator means (60).

17. Method according to claim 14, wherein the method employs a hydrodynamic action of a fluid applying the erosive action on said monitoring element to apply said stress.

18. Method according to claim 16, wherein the operation of analysing said response comprises analysing a modulus ($|u_x|$) for the Fourier transform of a displacement detected by said sensor means (120).

19. Method according to claim 14, wherein the method comprises transmitting (230) data pertaining to said response ($|u_x|$) to said stress ($f_s$) of the information to a control centre (150) positioned remotely.

20. Method according to claim 14, wherein the method comprises transmitting (230) commands at least for said actuator means (60) to apply said stress ($f_s$) from said control centre (60) positioned remotely.

21. Method according to claim 16, wherein the method comprises transmitting ( 230) data pertaining to said response ($|u_x|$) to said stress ($f_s$) of the information to a control centre (150) positioned remotely and further wherein the method provides for commanding said actuator means (60) to apply said stress ($f_s$) at predefined time intervals ($\Delta t$) .

22. Method according to claim 14, wherein the method comprises the operation of providing (100) a removable bearing for said monitoring element (15).

23. Method according to claim 14, wherein the method comprises the operation of measuring a pressure (p) applied on said monitoring element (15).

24. A monitoring element having structure that is capable of operating in a system for monitoring level variations of at least one bottom region (20) of a soil subjected to erosive and sedimentary agents, said system which utilizes at least one monitoring element (15) secured to said bottom region (20), said at least one monitoring element (15) comprising sensor means (120) to detect a response ($|u_x|$) of said at least one monitoring element (15) with respect to a stress ($f_s$), wherein said stress ($f_s$) is applied to said monitoring clement (15) to determine vibrations originating displacements ($|u_x|$) of at least part of said at least one monitoring element, said response detected by said sensor means is a function of said displacements ($|u_x|$) of at least pan of said at least one monitoring element (15) and that means (150) are provided for analysing said response with respect to a stress ($f_s$) applied to said monitoring element (15), identifying in said response characteristic frequencies ($\lambda_i$*) of the displacements of said monitoring element (15) and correlating said characteristic frequencies ($\lambda_i$*) with a lowering ($\Delta l_p$) of said bottom region (20).

* * * * *